US011739551B1

(12) United States Patent
Shanahan

(10) Patent No.: US 11,739,551 B1
(45) Date of Patent: Aug. 29, 2023

(54) POOL SEATING ASSEMBLY

(71) Applicant: Kevin Shanahan, Chico, CA (US)

(72) Inventor: Kevin Shanahan, Chico, CA (US)

( * ) Notice: Subject to any disclaimer, the term of this patent is extended or adjusted under 35 U.S.C. 154(b) by 0 days.

(21) Appl. No.: 17/669,132

(22) Filed: Feb. 10, 2022

(51) Int. Cl.
*E04H 4/14* (2006.01)

(52) U.S. Cl.
CPC ..... *E04H 4/14* (2013.01)

(58) Field of Classification Search
CPC ..... E04H 4/14
USPC ..... 4/488, 496
See application file for complete search history.

(56) References Cited

U.S. PATENT DOCUMENTS 4,837,869 A * 6/1989 Simmon ..... E04H 4/14 297/14
5,307,527 A * 5/1994 Schober ..... E04H 4/14 297/254
5,857,226 A * 1/1999 Sommer ..... E04H 4/14 297/254
5,860,171 A * 1/1999 Hicks ..... E04H 4/14 4/496
6,311,343 B1 * 11/2001 Wisniewski ..... E04H 4/144 4/578.1
6,637,045 B1 * 10/2003 Larsen ..... E04H 4/14 297/14
7,490,906 B2 * 2/2009 Schumacher ..... A47C 7/407 296/65.01
8,783,765 B1 * 7/2014 Matus ..... A47D 1/10 4/578.1
D714,562 S * 10/2014 Chlapaty ..... D6/362
9,015,874 B2 * 4/2015 Slater ..... A61H 33/00 4/578.1
9,212,497 B2 * 12/2015 Chlapaty ..... A47C 4/286
9,260,879 B1 * 2/2016 Benhacene ..... A47D 1/10
9,474,380 B2 * 10/2016 Chlapaty ..... A47C 15/004
9,681,755 B1 * 6/2017 Schober ..... A47C 15/006
10,458,138 B2 * 10/2019 Masterson ..... E06C 1/36
11,234,522 B1 * 2/2022 Marvin ..... A47C 3/16
2008/0093895 A1 4/2008 Deckert
2011/0099708 A1 * 5/2011 Freedman ..... A47C 15/004 4/496
2015/0091351 A1 * 4/2015 Chlapaty ..... A47C 1/14 297/313
2015/0121614 A1 * 5/2015 Hasty ..... E04H 4/144 4/496
2021/0172190 A1 * 6/2021 Steinman ..... A47C 1/14

FOREIGN PATENT DOCUMENTS

WO WO2014179899 11/2014

* cited by examiner

*Primary Examiner* — Lori L Baker

(57) ABSTRACT

A seating assembly for use in a pool includes a first frame, a second frame, and a seat. The first frame is substantially rectangular. The second frame is engaged to and extends substantially perpendicularly from the first frame. The second frame engages a pool surround as the first frame is inserted into a pool to engage a sidewall or a bottom of the pool. The seat is engaged to and extends substantially perpendicularly from the first frame so that the seat is positioned below a waterline of the pool. A user can sit upon the seat.

17 Claims, 6 Drawing Sheets

POOL SEATING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to seating assemblies and more particularly pertains to a new seating assembly for use in a pool. The present invention discloses a seating assembly comprising a frame with supporting cross straps, cup holders, and a vertically adjustable anchoring means to engage a pool surround to support a seat engaged to the frame at a user selectable position relative to a waterline of a pool.

(2) Description of Related Art Including Information Disclosed Under 37 CFR 1.97 and 1.98

The prior art relates to seating assemblies. Prior art seating assemblies may comprise chairs having anchoring means engaged to their backs. The anchoring means engage pool surrounds so that seats of the chair are submerged. What is lacking in the prior art is a seating assembly comprising a frame with supporting cross straps, cup holders, and a vertically adjustable anchoring means to engage a pool surround to support a seat engaged to the frame at a user selectable position relative to a waterline of a pool.

BRIEF SUMMARY OF THE INVENTION

An embodiment of the disclosure meets the needs presented above by generally comprising a first frame, a second frame, and a seat. The first frame is substantially rectangular. The second frame is engaged to and extends substantially perpendicularly from the first frame. The second frame is configured to engage a pool surround as the first frame is inserted into a pool to engage a sidewall or a bottom of the pool. The seat is engaged to and extends substantially perpendicularly from the first frame so that the seat is positioned below a waterline of the pool. The seat is configured to seat a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
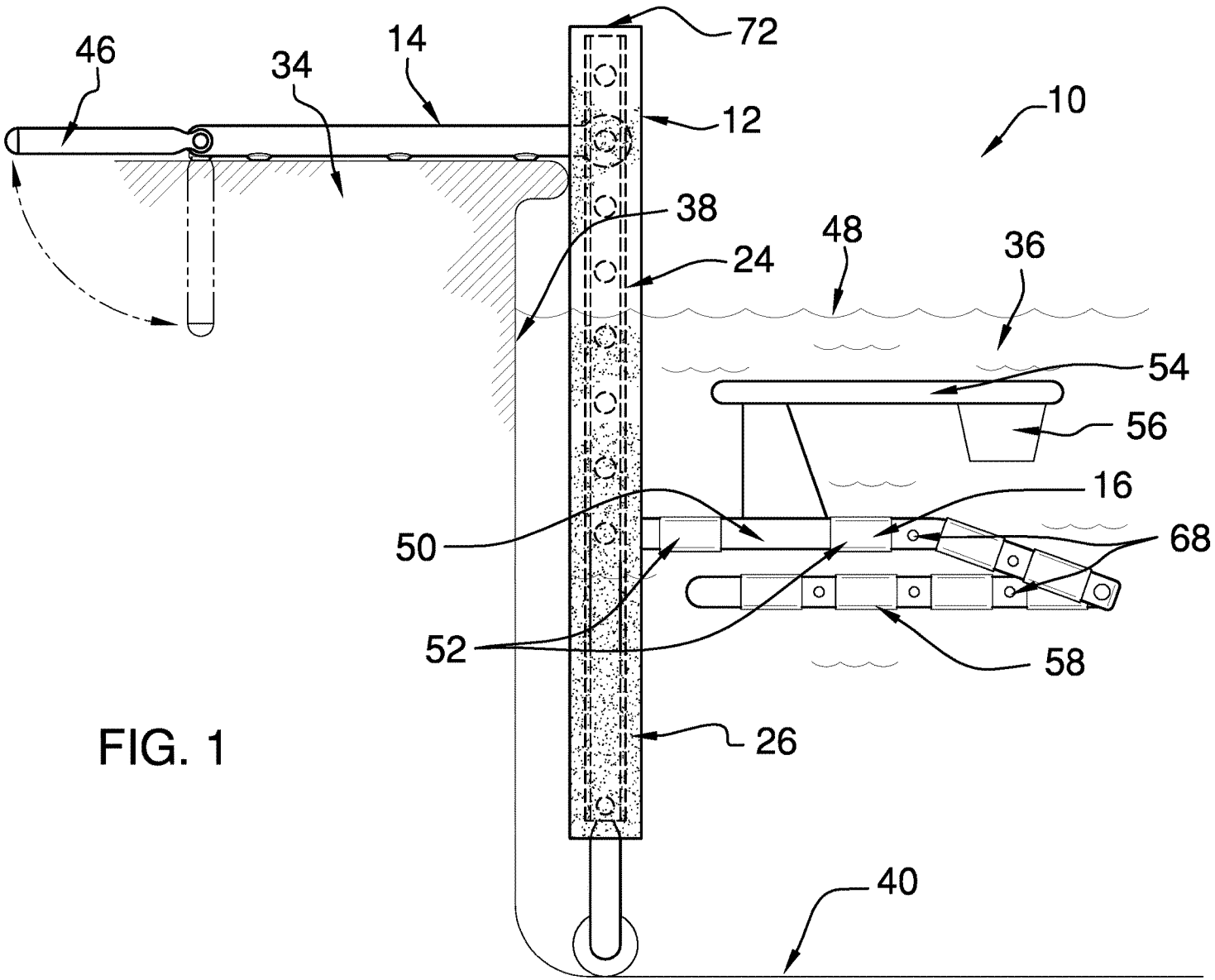
FIG. 1 is a side in-use view of a pool seating assembly according to an embodiment of the disclosure.
Figure 2:
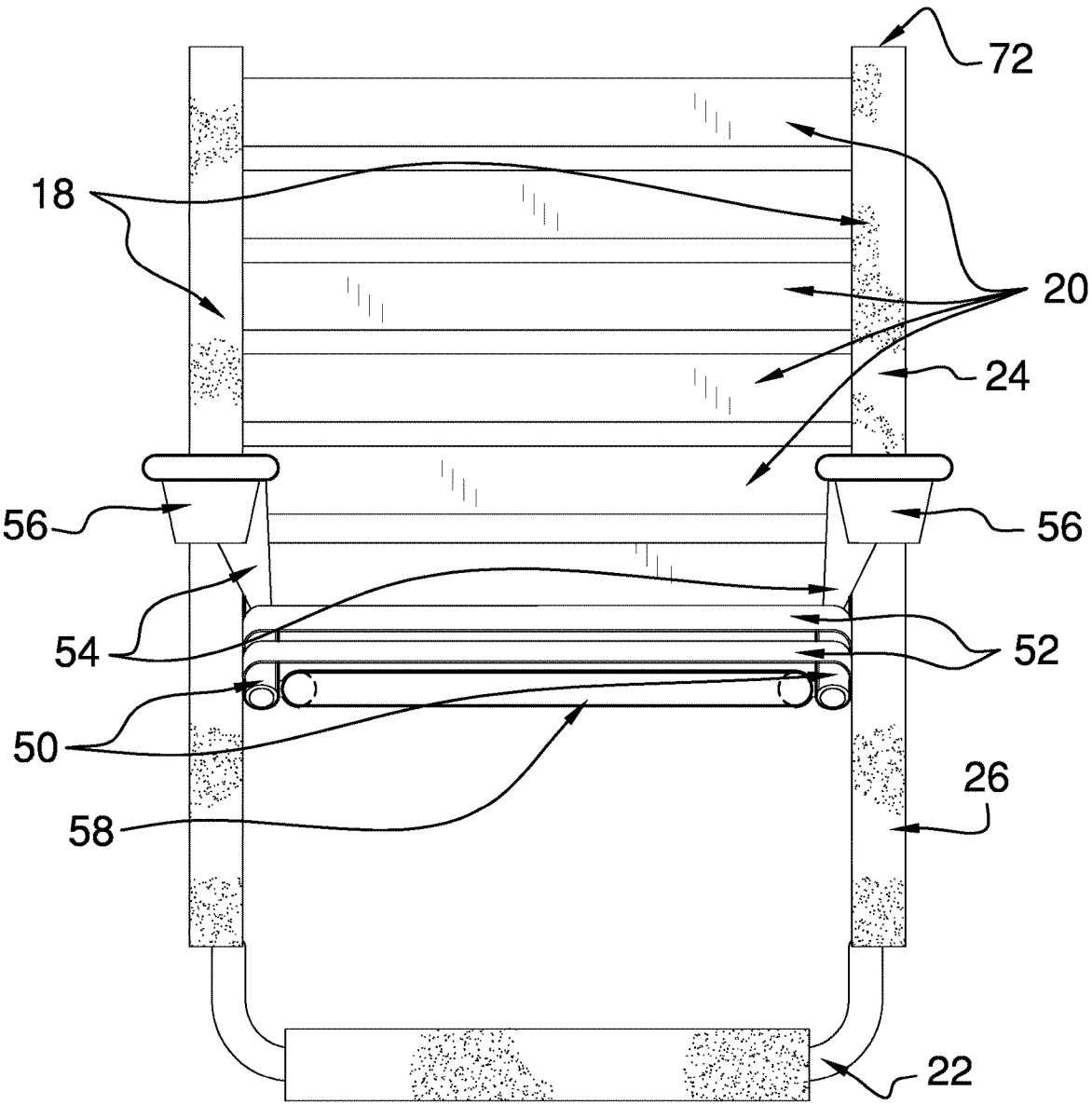
FIG. 2 is a front view of an embodiment of the disclosure.
Figure 3:
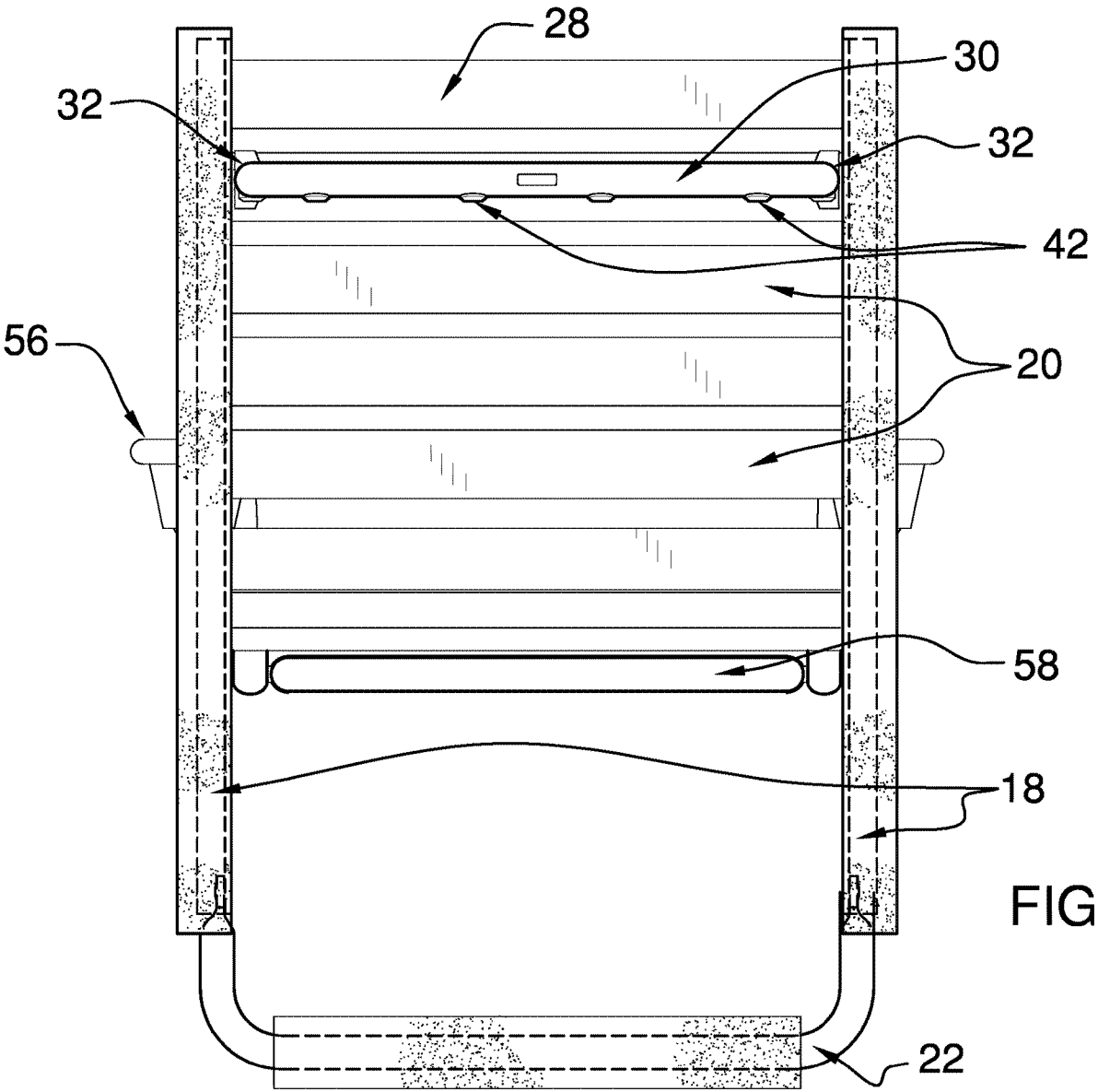
FIG. 3 is a rear view of an embodiment of the disclosure.

With reference now to the drawings, and in particular to FIGS. 1 through 6 thereof, a new seating assembly embodying the principles and concepts of an embodiment of the disclosure and generally designated by the reference numeral 10 will be described.

Figure 4:
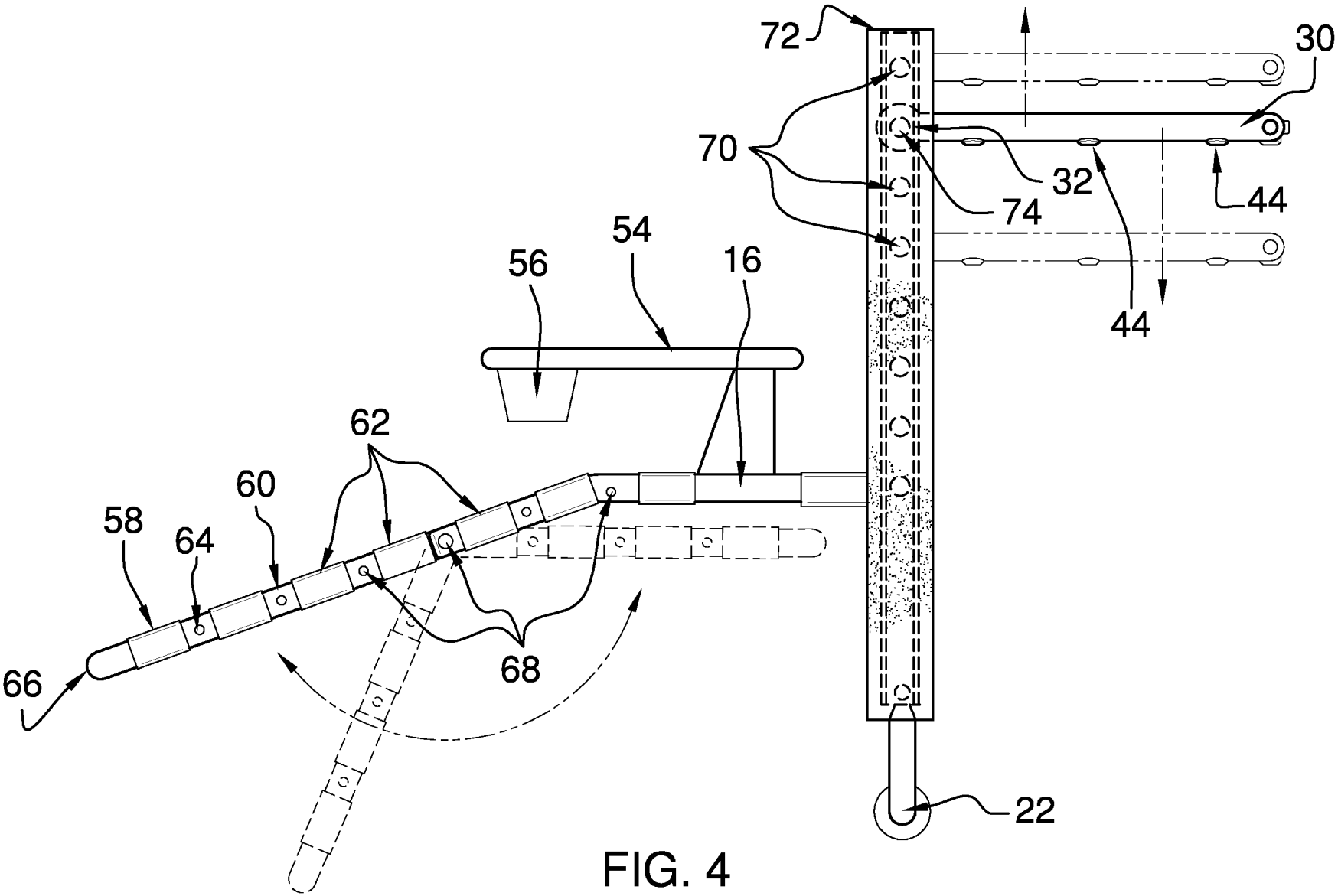
FIG. 4 is a side view of an embodiment of the disclosure.
Figure 5:
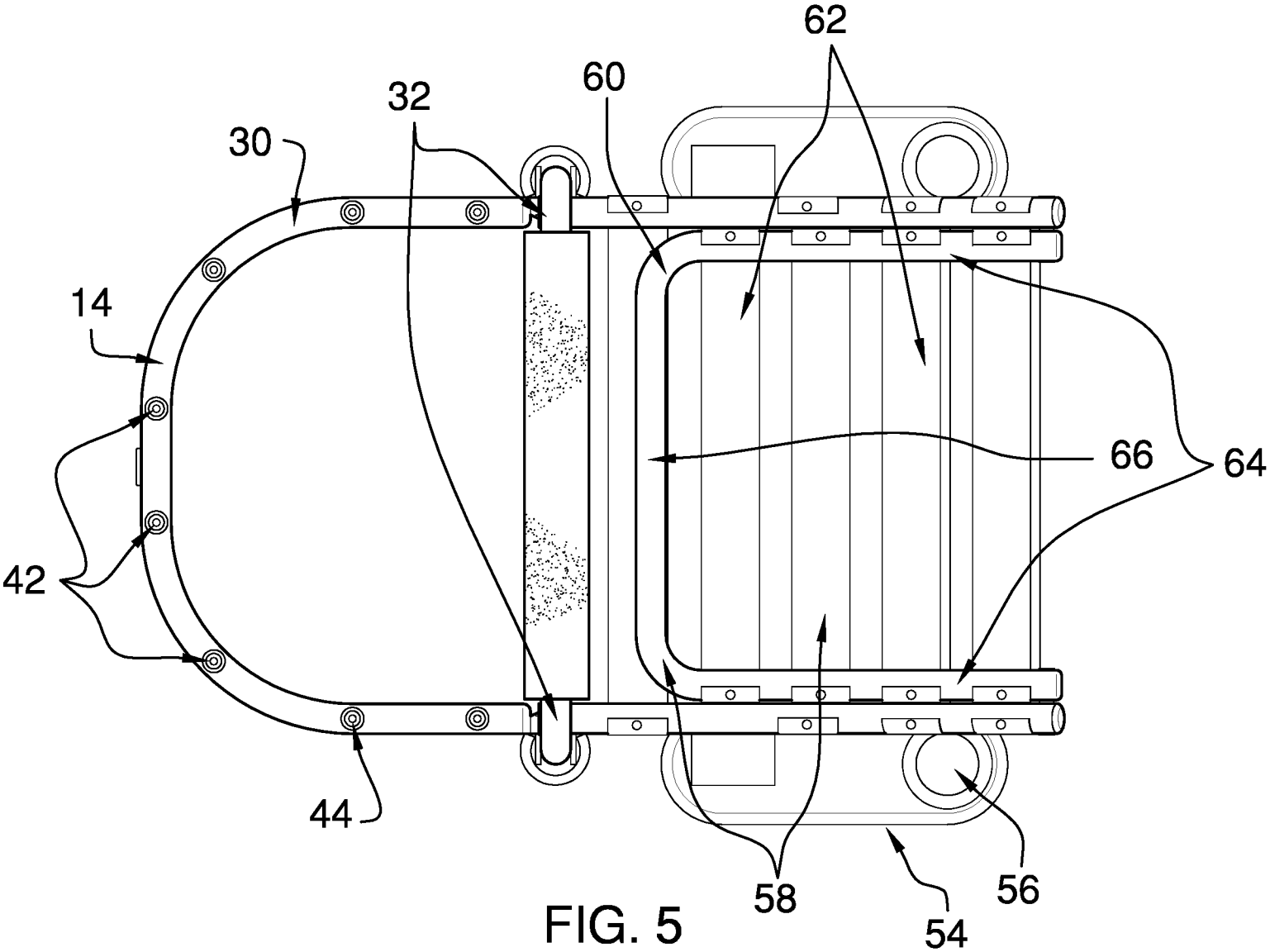
FIG. 5 is a bottom view of an embodiment of the disclosure.
Figure 6:
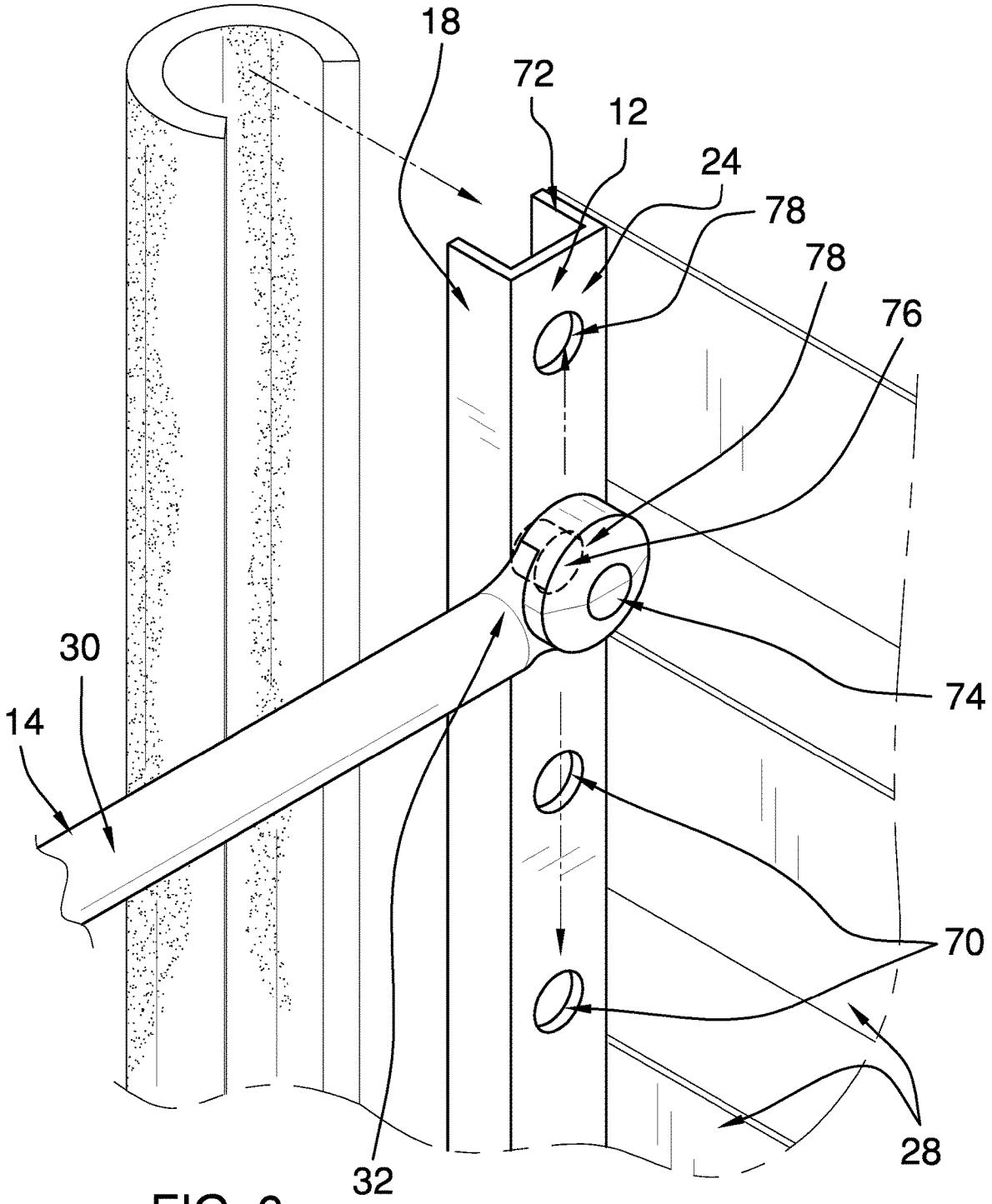
FIG. 6 is a detail view of an embodiment of the disclosure.

As best illustrated in FIGS. 1 through 6, the pool seating assembly 10 generally comprises a first frame 12, a second frame 14, and a seat 16. The first frame 12 is substantially rectangular. The first frame 12 may comprise a pair of side members 18, a plurality of back straps 20, and a bottom member 22. Each side member 18 comprises an upper segment 24 and a lower segment 26. The present invention also anticipates each side member 18 comprising a plurality of nested sections (not shown) so that the side member 18 is selectively length adjustable. Each back strap 20 is engaged to and extends between the upper segments 24 of the side members 18, thereby defining a backrest 28. The bottom member 22 is engaged to and extends between the lower segments 26 distal from the upper segments 24. The side members 18 and the bottom member 22 may be padded, as shown in FIGS. 1 and 6. As will become apparent, the side members 18 and the bottom member 22 being padded reduces a probability of damaging elements of a pool 36.

The second frame 14 is engaged to and extends substantially perpendicularly from the first frame 12. The second frame 14 comprises a rod 30, which has opposed ends 32 and which is nonlinear. Each opposed end 32 is engaged to a respective side member 18. The rod 30 may be arcuate so that the second frame 14 is C-shaped, although the present invention anticipates the rod 30 being alternatively shaped, such as, but not limited to, V-shaped, T-shaped, and the like. The second frame 14 is configured to engage a pool surround 34 as the first frame 12 is inserted into the pool 36 to engage a sidewall 38 or a bottom 40 of the pool 36, as shown in FIG. 1.

A plurality of fasteners 42 is engaged to the second frame 14 and is configured to selectively engage the pool surround 34 to removably engage the second frame 14 to the pool surround 34. Each fastener 42 may comprise a tab 44, which is resiliently compressible and thus configured to frictionally engage the pool surround 34. The tab 44 comprises rubber, silicon, or elastomer. The present invention anticipates the fastener 42 comprising other fastening means, such as, but not limited to, suction cups, hook and loop fasteners, and the like.

As shown in FIG. 1, a bracket 46 may be hingedly engaged to the second frame 14 distal from the first frame 12. The bracket 46 is configured to be hinged to engage an outer face of the sidewall 38 of an above-ground pool 36 (not shown).

The seat 16 is engaged to and extends substantially perpendicularly from the first frame 12 so that the seat 16 is positioned below a waterline 48 of the pool 36. The seat 16 is configured to seat a user. The present invention also anticipates the seat 16 being configured to seat more than one user. The seat 16 comprises a pair of first tubes 50 and a plurality of first straps 52. Each first tube 50 is engaged to and extends substantially perpendicularly from a respective side member 18. The first straps 52 are engaged to and extends between the first tubes 50. The present invention anticipates the seat 16 being alternatively constructed, such as, but not limited to, porous panels in place of the first straps 52, an end member engaged to and extending between the first tubes 50 distal from the side members 18, and the like.

A pair of armrests 54 is engaged to the seat 16 or the first frame 12 so that the armrests 54 are positioned above the seat 16. The armrests 54 thus are configured to supports arms of a user who is seated upon the seat 16. As shown in FIG. 4, the armrests 54 are engaged to the seat 16. A cup holder 56 is engaged to a respective armrest 54 and is configured to engage a cup (not shown) to removably engage the cup to the respective armrest 54. As shown in FIG. 5, each armrest 54 may be fitted with a cup holder 56.

A footrest 58 is hingedly engaged to the seat 16 so that the footrest 58 is selectively positionable in a stowed configuration and a deployed configuration, as shown in FIG. 4. In the stowed configuration, the footrest 58 is positioned below and proximate to the seat 16. In the deployed configuration, the footrest 58 extends substantially coplanarly from the seat 16. The footrest 58 is configured to support feet and lower legs of the user who is positioned on the seat 16.

The footrest 58 comprises a second tube 60 and a plurality of second straps 62. The second tube 60 comprises a pair of first sections 64 and a second section 66. Each first section 64 is hingedly engaged to a respective first tube 50. The second section 66 is engaged to and extends between the first sections 64 distal from the first tubes 50. The second straps 62 are engaged to and extend between the first sections 64 of the second tube 60.

A plurality of holes 68 is positioned in the first tubes 50 and the second tube 60. The holes 68 are configured to allow filling of the first tubes 50 and the second tube 60 with water upon positioning of the seat 16 and the footrest 58 below the waterline 48. The filling of the first tubes 50 and the second tube 60 with water reduces buoyancy of the pool seating assembly 10.

The second frame 14 is selectively slidable along the upper segment 24 of the first frame 12 so that the seat 16 is selectively positionable relative to the waterline 48, as shown in FIG. 4. A plurality of first connectors 70 is engaged to the side members 18 so that each upper segment 24 has first connectors 70 extending from proximate to the lower segment 26 to proximate to an upper end 72 of the first frame 12. Each of a pair of second connectors 74 is engaged to the rod 30 proximate to a respective opposed end 32 of the rod 30. The second connectors 74 are complementary to the first connectors 70 so that the second connectors 74 are positioned to selectively engage respective first connectors 70 to removably engage the second frame 14 to the first frame 12. As shown in FIG. 6, each second connector 74 comprises a lock pin 76 and each respective first connector 70 comprises an aperture 78.

In use, the first frame 12 is inserted into the pool 36 to engage a sidewall 38 or a bottom 40 of the pool 36. The second frame 14 is slid along the upper segment 24 of the first frame 12 to position the seat 16 as desired relative to the waterline 48. The tabs 44 on the second frame 14 frictionally engage the pool surround 34 to retain the pool seating assembly 10 in position. The seat 16 this is configured to seat the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pool seating assembly comprising:

a first frame, the first frame being substantially rectangular;

a second frame engaged to and extending substantially perpendicularly from the first frame, wherein the second frame is configured for engaging a pool surround as the first frame is inserted into a pool to engage a sidewall or a bottom of the pool; and a seat engaged to and extending substantially perpendicularly from the first frame, such that the seat is positioned below a waterline of the pool, wherein the seat is configured for seating a user;

wherein the first frame comprises a pair of side members, each side member comprising an upper segment and a lower segment, a plurality of back straps, each back strap being engaged to and extending between the upper segments of the side members defining a backrest, and a bottom member engaged to and extending between the lower segments distal from the upper segments;

wherein the second frame is selectively slidable along the upper segment of the first frame, such that the seat is selectively positionable relative to the waterline;

a plurality of first connectors engaged to the side members, such that each upper segment has first connectors extending from proximate to the lower segment to proximate to an upper end of the first frame; and a pair of second connectors, each second connector being engaged to the rod proximate to a respective opposed end of the rod, the second connectors being complementary to the first connectors, such that the second connectors are positioned for selectively engaging respective first connectors for removably engaging the second frame to the first frame.

2. The pool seating assembly of claim 1, wherein the side members and the bottom member are padded.

3. The pool seating assembly of claim 1, wherein the second frame comprises a rod, the rod having opposed ends and being nonlinear, each opposed end being engaged to a respective side member.

4. The pool seating assembly of claim 3, wherein the rod is arcuate, such that the second frame is C-shaped.

5. The pool seating assembly of claim 1, further including a plurality of fasteners engaged to the second frame and being configured for selectively engaging the pool surround for removably engaging the second frame to the pool surround.

6. The pool seating assembly of claim 5, wherein each fastener comprises a tab, the tab being resiliently compressible, wherein the tab is configured for frictionally engaging the pool surround.

7. The pool seating assembly of claim 6, wherein the tab comprises rubber, silicon, or elastomer.

8. The pool seating assembly of claim 1, further including a bracket hingedly engaged to the second frame distal from the first frame, wherein the bracket is configured for hinging for engaging an outer face of the sidewall of an above-ground pool.

9. The pool seating assembly of claim 1, wherein:

each second connector comprises a lock pin; and each respective first connector comprises an aperture.

10. The pool seating assembly of claim 1, wherein the seat comprises:

a pair of first tubes, each first tube being engaged to and extending substantially perpendicularly from a respective side member; and a plurality of first straps engaged to and extending between the first tubes.

11. The pool seating assembly of claim 1, further including a pair of armrests engaged to the seat or the first frame, such that the armrests are positioned above the seat, wherein the armrests are configured for supporting arms of a user seated upon the seat.

12. The pool seating assembly of claim 11, wherein the armrests are engaged to the seat.

13. The pool seating assembly of claim 11, further including a cup holder engaged to a respective armrest, wherein the cup holder is configured for engaging a cup for removably engaging the cup to the respective armrest.

14. The pool seating assembly of claim 10, further including a footrest hingedly engaged to the seat, such that the footrest is selectively positionable in a stowed configuration, wherein the footrest is positioned below and proximate to the seat, and a deployed configuration, wherein the footrest extends substantially coplanarly from the seat, wherein the footrest is configured for supporting feet and lower legs of the user.

15. A pool seating assembly comprising:

a first frame, the first frame being substantially rectangular;

a second frame engaged to and extending substantially perpendicularly from the first frame, wherein the second frame is configured for engaging a pool surround as the first frame is inserted into a pool to engage a sidewall or a bottom of the pool;

a seat engaged to and extending substantially perpendicularly from the first frame, such that the seat is positioned below a waterline of the pool, wherein the seat is configured for seating a user;

wherein the first frame comprises a pair of side members, each side member comprising an upper segment and a lower segment, a plurality of back straps, each back strap being engaged to and extending between the upper segments of the side members defining a backrest, and a bottom member engaged to and extending between the lower segments distal from the upper segments;

wherein the seat comprises a pair of first tubes, each first tube being engaged to and extending substantially perpendicularly from a respective side member, and a plurality of first straps engaged to and extending between the first tubes;

a footrest hingedly engaged to the seat, such that the footrest is selectively positionable in a stowed configuration, wherein the footrest is positioned below and proximate to the seat, and a deployed configuration, wherein the footrest extends substantially coplanarly from the seat, wherein the footrest is configured for supporting feet and lower legs of the user; and wherein the footrest comprises a second tube comprising a pair of first sections and a second section, each first section being hingedly engaged to a respective first tube, the second section being engaged to and extending between the first sections distal from the first tubes, and a plurality of second straps engaged to and extending between the first sections of the second tube.

16. The pool seating assembly of claim 15 further including a plurality of holes positioned in the first tubes and the second tube, wherein the holes are configured for filling of the first tubes and the second tube with water upon positioning of the seat and the footrest below the waterline.

17. A pool seating assembly comprising:

a first frame, the first frame being substantially rectangular, the first frame comprising:

a pair of side members, each side member comprising an upper segment and a lower segment, the side members being padded, a plurality of back straps, each back strap being engaged to and extending between the upper segments of the side members defining a backrest, and a bottom member engaged to and extending between the lower segments distal from the upper segments, the bottom member being padded;

a second frame engaged to and extending substantially perpendicularly from the first frame, wherein the second frame is configured for engaging a pool surround as the first frame is inserted into a pool to engage a sidewall or a bottom of the pool, the second frame comprising a rod, the rod having opposed ends and being nonlinear, each opposed end being engaged to a respective side member, the rod being arcuate, such that the second frame is C-shaped;

a plurality of fasteners engaged to the second frame and being configured for selectively engaging the pool surround for removably engaging the second frame to the pool surround, each fastener comprising a tab, the tab being resiliently compressible, wherein the tab is configured for frictionally engaging the pool surround, the tab comprising rubber, silicon, or elastomer;

a bracket hingedly engaged to the second frame distal from the first frame, wherein the bracket is configured for hinging for engaging an outer face of the sidewall of an above-ground pool;

a seat engaged to and extending substantially perpendicularly from the first frame, such that the seat is positioned below a waterline of the pool, wherein the seat is configured for seating a user, the second frame being selectively slidable along the upper segment of the first frame, such that the seat is selectively positionable relative to the waterline, the seat comprising:

a pair of first tubes, each first tube being engaged to and extending substantially perpendicularly from a respective side member, and a plurality of first straps engaged to and extending between the first tubes;

a plurality of first connectors engaged to the side members, such that each upper segment has first connectors extending from proximate to the lower segment to proximate to an upper end of the first frame;

a pair of second connectors, each second connector being engaged to the rod proximate to a respective opposed end of the rod, the second connectors being complementary to the first connectors, such that the second connectors are positioned for selectively engaging respective first connectors for removably engaging the second frame to the first frame, each second connector comprising a lock pin, each respective first connector comprising an aperture;

a pair of armrests engaged to the seat or the first frame, such that the armrests are positioned above the seat, wherein the armrests are configured for supporting arms of a user seated upon the seat, the armrests being engaged to the seat;

a cup holder engaged to a respective armrest, wherein the cup holder is configured for engaging a cup for removably engaging the cup to the respective armrest;

a footrest hingedly engaged to the seat, such that the footrest is selectively positionable in a stowed configuration, wherein the footrest is positioned below and proximate to the seat, and a deployed configuration, wherein the footrest extends substantially coplanarly from the seat, wherein the footrest is configured for supporting feet and lower legs of the user, the footrest comprising:

a second tube comprising a pair of first sections and a second section, each first section being hingedly engaged to a respective first tube, the second section being engaged to and extending between the first sections distal from the first tubes, and a plurality of second straps engaged to and extending between the first sections of the second tube; and a plurality of holes positioned in the first tubes and the second tube, wherein the holes are configured for filling of the first tubes and the second tube with water upon positioning of the seat and the footrest below the waterline.

* * * * *